US008598801B2

(12) United States Patent
Yamashita et al.

(10) Patent No.: US 8,598,801 B2
(45) Date of Patent: Dec. 3, 2013

(54) ELECTRIC SUPPLY DEVICE

(75) Inventors: Takashi Yamashita, Hyogo (JP); Hirohisa Iwabayashi, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 22 days.

(21) Appl. No.: 13/471,082

(22) Filed: May 14, 2012

(65) Prior Publication Data

US 2012/0286695 A1 Nov. 15, 2012

(30) Foreign Application Priority Data

May 13, 2011 (JP) ..... 2011-107854

(51) Int. Cl.

| | |
|---|---|
| ***H05B 41/16*** | (2006.01) |
| ***H05B 41/24*** | (2006.01) |
| ***H05B 37/02*** | (2006.01) |
| ***H05B 39/04*** | (2006.01) |
| ***H05B 41/36*** | (2006.01) |
| ***G05F 1/00*** | (2006.01) |

(52) U.S. Cl.
USPC ..... 315/286; 315/209 R; 315/246; 315/291

(58) Field of Classification Search
None
See application file for complete search history.

(56) References Cited

U.S. PATENT DOCUMENTS

2010/0244720 A1 * 9/2010 Tsukamoto et al. ..... 315/246
2010/0271322 A1 10/2010 Ichikawa et al.

FOREIGN PATENT DOCUMENTS

JP 2009-198886 A 9/2009
JP 2009198886 A * 9/2009
JP 2010-238526 A 10/2010

* cited by examiner

*Primary Examiner* — Douglas W Owens
*Assistant Examiner* — Dedei K Hammond
(74) *Attorney, Agent, or Firm* — Rader, Fishman & Grauer PLLC

(57) ABSTRACT

An electric supply device for a high-pressure discharge lamp comprising: an electric supply device control unit, having a function of switching between a steady lighting mode and a low power lighting mode in which electric power lower than the electric power in the steady lighting mode is supplied to the high pressure discharge lamp. While in the low power lighting mode, predetermined base current is continuously supplied to the high pressure discharge lamp and a current supply command signal is sent so that boost current obtained by superimposing current having a predetermined magnitude on the base current, is periodically supplied thereto, and a luminance control signal for adjusting the luminance of a video signal of a liquid crystal projector apparatus according to a magnitude of the electric power of the high pressure discharge lamp, which is operated responding to the supply of the boost current, is sent.

4 Claims, 6 Drawing Sheets

FIG. 1
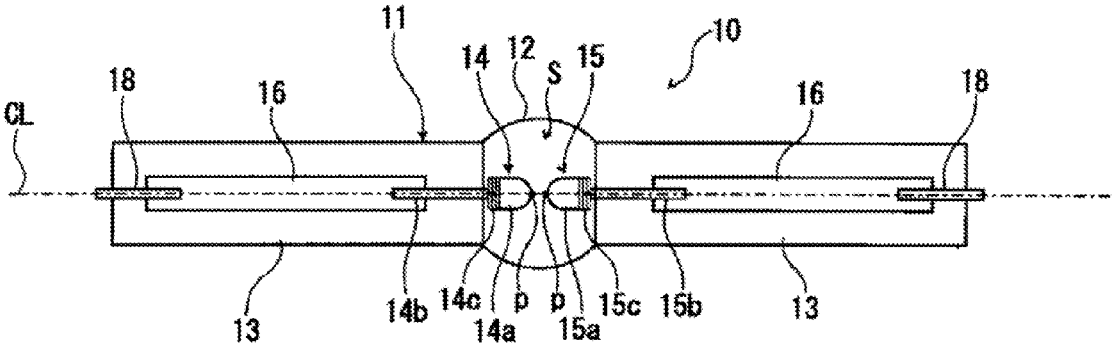
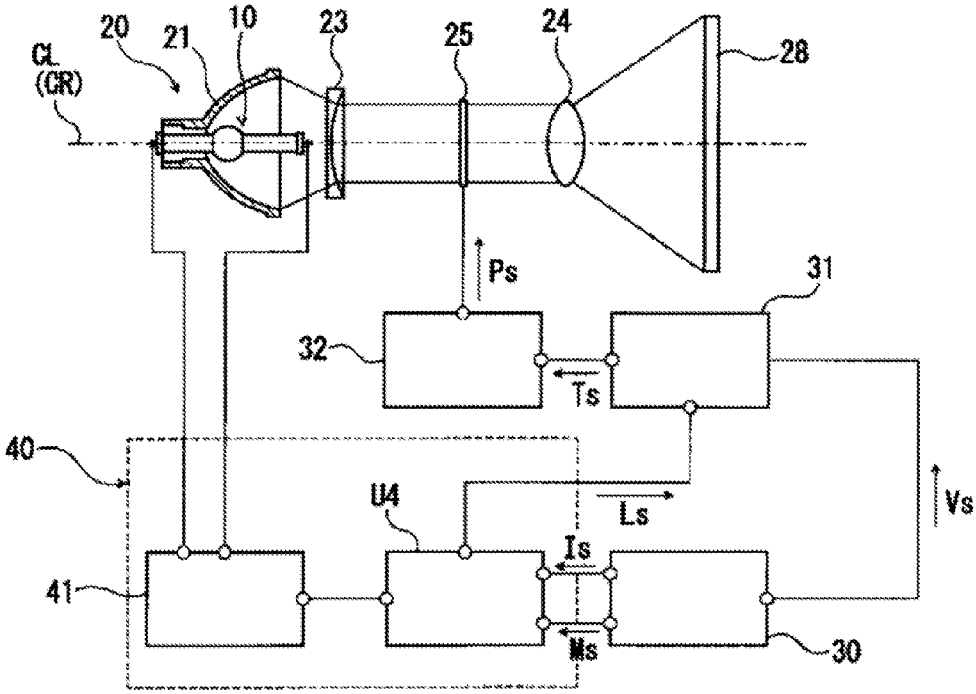
FIG. 2

ELECTRIC SUPPLY DEVICE

CROSS-REFERENCES TO RELATED APPLICATION

This application claims priority from Japanese Patent Application Serial No. 2011-107854 filed May 13, 2011, the contents of which are incorporated herein by reference in its entirety.

BACKGROUND

1. Technical Field

Technical Field: The present invention relates to an electric supply apparatus for a high pressure discharge lamp which can be suitably used as a light source of a liquid crystal projector apparatus which has a light modulation function.

2. Related Art

In a projection type projector apparatus, there is a demand for an image with uniform and sufficient color reproduction nature, which is projected on a rectangular screen. For this reason, a short arc type high pressure discharge lamp, in which the mercury vapor pressure thereof reaches, for example, 150 atmospheres or more when it is lit, is adopted as a light source and is, for example, lighted in an alternating current lighting method when steady lighting is used. In recent years, a projector apparatus, which has a light modulation function capable of adjusting the brightness of a screen according to the brightness of the environment or a kind of image to be projected, has been developed, in which, for example, the so-called "brightness adjustment mode" using a dimming function so as to raise contrast by decreasing electric power according to such a screen, or a low power lighting modes such as the so-called "super energy saving mode" etc. for decreasing electric power is adopted. In such a projector apparatus, it is required that electric power in a low power lighting mode be reduced to 25-70% of the rated power.

However, in the low power lighting mode, the position of the arc in the light source becomes unstable and a flicker tends to occur, because the tip of an electrode decreases in temperature due to the decrease of the electric power applied to the electrode tip. Japanese Patent Application Publication No. 2010-238526 discloses that, in order to solve such a problem, in a low power lighting mode in which electric power of, for example, 70% or less of the rated power is supplied to a high pressure discharge lamp to light the lamp, base lighting and boost lighting are performed by turns, wherein in the base lighting, base current having a predetermined frequency is supplied to the lamp, and in the boost lighting, boost current whose value is larger than a value of the base current is supplied thereto.

On the other hand, there is a known problem in which, when electric power to be supplied is increased so as to light such a discharge lamp in alternating current lighting, since the luminance of the lamp increases as the electric power is increased, areas with different brightness in a projection image are generated, so that a horizontal stripe noise is perceived on the projection image which is projected on a screen. In order to solve such a problem, Japanese Patent Application Publication No. 2009-198886 discloses, as shown in FIG. 7, that in a liquid crystal projector, in which a liquid crystal panel is irradiated with light emitted from the light source driven by alternating current (thereby generating a projection image light), in a period (pulse period t1) in which boost lighting is carried out, the luminance of a video signal is decreased by a predetermined amount ΔL based on a vertical synchronizing signal for driving a panel, which determines a vertical blanking period of the liquid crystal panel, whereby generation of the horizontal stripe noise of the projection image which is projected on a screen is supposed to be prevented while generation of a flicker is suppressed.

However, just as in the discharge lamp lighting apparatus disclosed in Japanese Patent Application Publication No. 2010-238526, it turns out that in the discharge lamp lighting apparatus disclosed in Japanese Patent Application Publication No. 2009-198886 areas of different brightness are generated by carrying out boost lighting in the low power lighting mode, in which electric power smaller than the rated power is supplied to a high pressure discharge lamp in order to light the discharge lamp. The present inventors made a prototype of a liquid crystal projector apparatus equipped with a lamp lighting apparatus using the technology disclosed in Japanese Patent Application Publication No. 2009-198886, wherein the high pressure discharge lamp is lighted in the low power lighting mode, in which, electric power lower than the rated power is supplied to the high pressure discharge lamp based on constant electric power control and wherein the transmittance of a liquid crystal panel is controlled in the low power lighting mode. Then, the present inventors confirmed that the above-mentioned problem were not be solved by the technology disclosed in Japanese Patent Application Publication No. 2009-198886. The reasons therefor are set forth below.

Since the temperature of vapor in the electrical discharge space and the temperature of the electrodes are low when the high pressure discharge lamp is lighted in the low power lighting mode, mercury in the electrical discharge space is unsaturated, that is, part of the mercury aggregates, so that it is necessary to take time to evaporate the mercury. Therefore, a change of lamp lighting power cannot be actually predicted in response to a steep change of a current supply command signal, when the high pressure discharge lamp is lighted in the boost lighting. For this reason, even when the current supply command signal is transmitted so that the boost current, which is obtained by superimposing current having a predetermined constant magnitude on the base current, is supplied to the discharge lamp in the boost lighting period of a predetermined fixed cycle, the lamp current that actually flows through the high pressure discharge lamp changes in every boost lighting period, so that desired boost lighting cannot be performed. And since the luminance of light emitted from the discharge lamp depends on lamp power, and this lamp power is determined by the lamp current that actually flows through the discharge lamp and the lamp lighting voltage, the lamp lighting power WL also changes in every boost lighting period, resulting in the luminance of the light emitted from the high pressure discharge lamp varying in every boost lighting period. Accordingly, the luminance is not constant and it is impossible to know (predict) the luminance thereof in advance.

Therefore, in the technology disclosed in Japanese Patent Application Publication No. 2009-198886, in which the luminance of the light emitted from the high pressure discharge lamp is decreased by a predetermined constant amount ΔL at predetermined times in a fixed boost lighting period in the boost lighting mode, since a state of the boost lighting to be controlled varies in every boost lighting period in practice, light (or the luminance thereof) cannot be sufficiently reduced in a certain boost lighting period, or it is reduced too much in another boost lighting period, so that areas with different brightness in a projection image differs are generated.

SUMMARY

The present invention was made in view of the above background, and it is an object of the present invention to offer an electric supply device for a high pressure discharge lamp, which is capable of preventing or controlling generation of luminance unevenness and generation of a flicker when the discharge lamp is lighted in a low power lighting mode.

According to the present invention, an electric supply device for supplying alternating current to a high pressure discharge lamp used as a light source of a liquid crystal projector apparatus, comprises an electric supply device control unit, having a function of switching between a steady lighting mode in which first electric power not less than 70% of the rated power is supplied to the high pressure discharge lamp and a low power lighting mode in which second electric power lower than the first electric power in the steady lighting mode is supplied to the high pressure discharge lamp by performing constant electric power control, thereby lighting the high pressure discharge lamp, wherein the electric supply device control unit has a function in which while in the low power lighting mode, a predetermined base current is continuously supplied to the high pressure discharge lamp and a current supply command signal is sent so that boost current obtained by superimposing current having a predetermined magnitude on the base current, is periodically supplied thereto, and a luminance control signal for adjusting the luminance of a video signal of the liquid crystal projector apparatus according to a magnitude of operation power of the high pressure discharge lamp, which is operated responding to the supply of the boost current, is sent.

In the electric supply device for a high-pressure discharge lamp according to the present invention, the luminance control signal may be set according to a power difference between the operation power of the high pressure discharge lamp in which base lighting is performed by supply of the base current and the operation power of the high pressure discharge lamp in which boost lighting is carried out by supply of the boost current.

In the electric supply device for a high-pressure discharge lamp according to the present invention, in the low power lighting mode, the current supply command signal controls, according to a measured value of a lighting voltage of the high pressure discharge lamp: a supplying timing of the boost current, a magnitude of the boost current, or a supplying period of the boost current.

According to the electric supply device for a high-pressure discharge lamp of the present invention, where, at time of the boost lighting in the low power lighting mode, the luminance control signal for adjusting the luminance of a video signal of the liquid crystal projector apparatus, which corresponds to the magnitude of the lamp lighting power of the high pressure discharge lamp operated by supply of the boost current, is sent by the electric supply device control unit, since the transmittance of the liquid crystal panel is controlled by an adjustment amount adapted to the actual boost lighting state at time of the boost lighting, it is possible to prevent or control generation of areas where brightness in the projection image projected on a projection screen differs from that of other areas (for example, generation of the luminance unevenness due to horizontal stripe noise etc.), while generation of a flicker is controlled.

BRIEF DESCRIPTION OF THE DRAWINGS

Other features and advantages of the present electric supply device will be apparent from the ensuing description, taken in conjunction with the accompanying drawings, in which:

FIG. 1 is a cross sectional view of a schematic structure of an example of a high pressure discharge lamp, taken along a plane which is along the tube axis thereof;

FIG. 2 is a block diagram showing a schematic structure of an example of a liquid crystal projector apparatus equipped with an electric supply device for a high pressure discharge lamp according to the present invention;

DESCRIPTION

Figure 3:
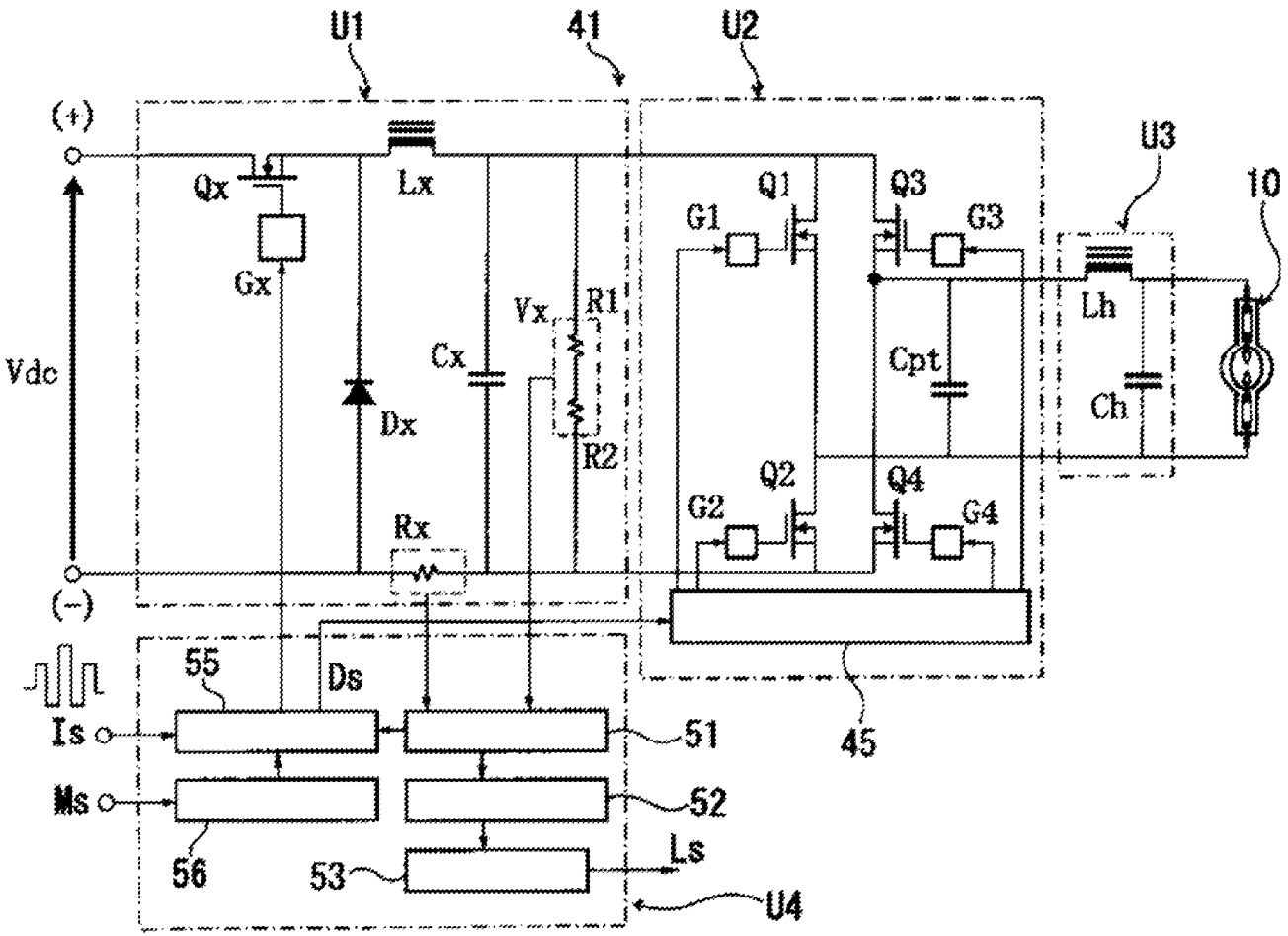
FIG. 3 is a block diagram showing a schematic structure of an example of an electric supply device for a high pressure discharge lamp according to the present invention.

Detailed description of embodiments according to the present invention will be given below. An electric supply device for a high pressure discharge lamp according to the present invention is installed in a liquid crystal projector apparatus, which has, for example, a light modulation function, and which supplies alternating current power to the high pressure discharge lamp. First, the high pressure discharge lamp to which electric power is supplied by the electric supply device according to the present invention will be described below.

High Pressure Discharge Lamp

FIG. 1 is an explanatory cross sectional view of a schematic structure of an example of the high pressure discharge lamp, taken along a plane which is along the tube axis thereof, to which electric power is supplied by the electric supply apparatus according to the present invention. The high pressure discharge lamp 10 is lighted by an alternating current lighting method, and comprises an arc tube 11 which includes an arc tube portion 12 and rod shaped sealing portions 13. The arc tube portion 12, whose outer shape is approximately spherical, forms an electrical discharge space S therein. The rod shape sealing portions 13 are integrally and continuously formed at both ends of the arc tube portion 12, and respectively extend outward along a tube axis CL thereof. In the arc tube portions 12 of the arc tube 11, a pair of electrodes 14 and 15, which are made of tungsten, are arranged so as to face each other. Specifically, each of the pair of electrodes 14 (15), comprises a rod shaped axis portion 14*b* (15*b*) which extends along the tube axis CL of the arc tube 11, an approximately spherical head portion 14*a* (15*a*) which has a projection p, and which is formed continuously from the tip of the axis portion 14*b* (15*b*), a coil portion 14*c* (15*c*), which is wound around a tip portion of the axis portion 14*b* (15*b*) and a back end portion of the head portion 14*a* (15*a*), wherein the head portions 14*a* and 15*a* face each other, and a base end portion of each axis portion 14*b* (15*b*) is buried in each sealing portion 13 so as to be held thereby. Here, a distance between these electrodes is 2.0 mm or less, for example, 0.5-2.0 mm. A metallic foil 16, which is made of molybdenum, is airtightly buried inside each of the sealing portions 13 of the arc tube 11. The base end of the axis portion 14*b* (15*b*) of each of the pair of electrodes 14 (15) is welded, and electrically connected to one end of each metallic foil 16. On the other hand, an external lead 18, which is projected outward from an outer end of each sealing portion 13, is welded and electrically connected to the other end of each metallic foil 16.

The arc tube 11 is made of silica glass. For example, mercury, rare gas, and halogen are enclosed in the arc tube portion 12 of the arc tube 11. In order to obtain a required visible light wavelength, for example, radiation light having a wavelength of 360-780 nm, the mercury is enclosed in the arc tube portion 12. The amount of enclosed mercury is 0.15 $mg/mm^3$ or more, so that high mercury vapor pressure of 150 atmospheres or more may be secured at time of lighting. High mercury vapor pressure (200 atmospheres or more or 300 atmospheres or more) can be obtained during lighting by increasing the amount of enclosed mercury, so that a light source suitable for a projector apparatus can be realized. To improve the process of beginning light emission from the light source, the rare gas is enclosed in the arc tube portion 12. The enclosure pressure thereof is 10-26 kPa in static pressure. Moreover, argon gas can be used as the rare gas conveniently. The halogen enclosed in the arc tube portion 12 forms a halogen cycle in the arc tube portion 12, so that tungsten, which is an electrode substance, is controlled so as not to adhere to the inner wall of the arc tube portion 12, wherein the halogen is enclosed in the form of a compound of mercury and other metal(s).

The amount of enclosed halogen is, for example, $1\times10^{-6}$ to $1\times10^{-2}$ $\mu mol/mm^3$. Moreover, iodine, bromine, chlorine, etc. can be used as the halogen. Moreover, metal halide can also be enclosed as another discharge medium in the arc tube portion 12.

The specification of such a high pressure discharge lamp 10 will be shown below as an example. The maximum outer diameter of the arc tube portion 12 in the arc tube 11 is 12 mm. The distance between the electrodes is 1.2 mm. The internal volume of the arc tube portion 12 in the arc tube 11 is 120 $mm^3$. Rated voltage is 85 V and rated power is 300 W. Moreover, since the mercury vapor pressure in the arc tube portion 12 of the high pressure discharge lamp 10 turns into 150 atmospheres or more during lighting and further a miniaturization of the entire structure of a projector apparatus and high light intensity are required, the thermal conditions of the arc tube portion 12 of the arc tube 11 of the high pressure discharge lamp 10 are very severe. For example, the bulb wall loading value of the high pressure discharge lamp 10 is 0.8 to 3.0 $W/mm^2$, more specifically 2.1 $W/mm^2$. Thus, radiation light having good color reproduction nature can be obtained by providing such high mercury vapor pressure and such a bulb wall loading value when the high pressure discharge lamp 10 is used as a light source of a projector apparatus.

Liquid Crystal Projector Apparatus

FIG. 2 is a block diagram showing a schematic structure of an example of a liquid crystal projector apparatus equipped with an electric supply device for a high pressure discharge lamp according to the present invention. FIG. 3 is a block diagram showing a schematic structure of an example of the electric supply device for a high pressure discharge lamp according to the present invention. The liquid crystal projector apparatus comprises an optical system and a control system. The optical system includes a lamp unit 20, an optical element 23 for irradiating a liquid crystal panel 25 with, for example, parallel light converted from light emitted from the lamp unit 20, and a projection lens 24 for projecting light (projection image) passing through the optical element 23 and the liquid crystal panel 25 on a projection screen 28. The control system includes a projector control device 30, an electric supply device 40 for a high pressure discharge lamp (hereinafter simply referred to as an "electric supply device"), a video signal control device 31 and a liquid crystal panel drive device 32. In addition, in the optical system, parts such as a color filter and a polarizing element are arranged if needed in addition to the above-mentioned component parts.

The lamp unit 20 which forms the optical system comprises the high pressure discharge lamp 10 and a reflector 21, which is made up of, for example, an elliptical face reflection mirror. The high pressure discharge lamp 10 is arranged so that the tube axis CL of the arc tube 11 is in agreement with an optical axis CR of the reflector 21, and the center of an arc is located at a position of the first focal point of the reflector 21.

The projector control device 30 has a function of outputting a current supply command signal Is and a lighting mode setting signal Ms to the electric supply device 40, and for outputting a video signal Vs to the video signal control apparatus 31.

The image signal control apparatus 31 has a function of outputting a liquid crystal transmittance control signal Ts, which is obtained by adjusting the luminance of the video signal Vs outputted from the projector control device 30, based on a luminance control signal Ls outputted from the electric supply device control unit U4.

The liquid crystal panel drive device 32 has a function of outputting a liquid crystal panel drive signal Ps according to the liquid crystal transmittance control signal Ts outputted from the video signal control apparatus 31, thereby controlling an operation of the liquid crystal panel 25. A concrete means for controlling the transmittance of the liquid crystal panel 25 is specifically not limited, and may be either a means for adjusting the arrangement of liquid crystal molecules in the liquid crystal panel 25 (degree of opening/closing) or a means for adjusting opening/closing time of the liquid crystal molecules (a period when the opening state of the liquid crystal molecules in the arrangement is maintained).

As shown in FIG. 3, the electric supply device 40 is equipped with a lamp lighting circuit 41 and the electric supply device control unit U4, which includes a processing unit such as a microprocessor etc. The lamp lighting circuit 41 comprises a step down chopper circuit U1 to which direct current voltage is supplied; a full bridge type inverter circuit U2 (hereinafter referred to as a "full bridged circuit") which is connected to an output side of the step down chopper circuit U1 and which converts direct current voltage into alternating current voltage and supplies it to the high pressure discharge lamp 10; and a starter circuit U3 including a capacitor Ch and a starter coil Lh, which is in series connected to the high pressure discharge lamp 10 between the full bridged circuit U2 and the high pressure discharge lamp 10.

The step down chopper circuit U1, which is part of the lamp lighting circuit 41, comprises a reactor Lx and a switching element Qx, which is connected to a positive electrode (+) side of a power supply terminal and which direct current voltage is supplied to; a diode Dx, whose cathode side is connected between a connection point of the switching element Qx and the reactor Lx and a negative electrode (−) side of the power supply terminal; a smoothing capacitor Cx connected to an output side of the reactor Lx; and a resistor Rx for current detection, which is connected between the negative electrode (−) side terminal of the smoothing capacitor Cx and the anode side of the diode Dx. In this step down chopper circuit U1, for example, when the switching element Qx which is made up of an IGBT, a FET, etc. is driven by a predetermined duty ratio corresponding to a gate signal Gx, input direct current voltage Vdc is decreased to a voltage corresponding to the duty ratio. And a series circuit Vx made up of resistors R1 and R2 for voltage detection is provided on an output side of the step down chopper circuit U1.

The full bridged circuit U2, which is part of the lamp lighting circuit 41, comprises four switching elements Q1-Q4 connected to one another so as to form a shape of a bridge, each of which is made up of an IGBT, a FET, etc., and a driver circuit 45, which drives these switching elements Q1-Q4, wherein the full bridged circuit U2 has a function of performing a polarity reversal operation according to a drive signal (gate signals G1-G4) outputted from the driver circuit 45. In this full bridged circuit U2, when a switching operation in which both the switching elements Q2 and Q3 are turned OFF while both the switching elements Q1 and Q4 are turned ON, and a switching operation in which both the switching elements Q2 and Q3 are turned ON while both the switching elements Q1 and Q4 are turned OFF, are carried out by turns by the driver circuit 45, a rectangle wave alternating current voltage is generated between a connection point of the switching elements Q1 and Q2, and a connection point of the switching elements Q3 and Q4, so that the rectangle wave alternating current is supplied to the high pressure discharge lamp 10. A capacitor Cpt is connected between an input side of the reactor Lh in the starter circuit U3 and a negative electrode side terminal of the capacitor Ch.

The electric supply device control unit U4 has a function of lighting the high pressure discharge lamp 10 by switching between a steady lighting mode and a low power lighting mode, wherein in the steady lighting mode, electric power not less than 70% of the rated power is supplied to the high pressure discharge lamp 10, and in the low power lighting mode, electric power lower than that in the steady lighting mode is supplied to the high pressure discharge lamp 10 by constant electric power control. That is, in the low power lighting mode, while base current having predetermined frequency selected from, for example, a range of 100 Hz-5 kHz is continuously supplied to the high pressure discharge lamp 10, boost current, which is obtained by superimposing current having a predetermined magnitude on the base current, is periodically supplied thereto. Here, as long as a value of the electric power supplied in the low power lighting mode is lower than a value of electric power in the steady lighting mode, there is no restriction thereon, but it is usually selected from a range of 40 to 70% of the rated power.

The electric supply device control unit U4 is the so-called controller which is formed by, for example, a processor (CPU), and comprises a current and voltage detecting unit 51, a power change amount calculation unit 52, an adjusted luminance calculation unit 53, a lighting power control unit 55, and a lighting mode setting unit 56.

The lighting mode setting unit 56 has a function of distinguishing the lighting mode of the high pressure discharge lamp 10 based on the lighting mode setting signal Ms inputted from the projector control device 30, and of sending out a result thereof to the lighting power control unit 55.

The lighting power control unit 55, by which the lighting state of the high pressure discharge lamp 10 is controlled, has a function of controlling the magnitude of electric power supplied to the high pressure discharge lamp 10 and a boost rate in case of boost lighting, which is described below, by outputting the gate signal Gx for driving the switching element Qx of the step down chopper circuit U1 at the set duty ratio according to the current supply command signal Is outputted from the projector control device 30. The boost rate is a ratio (Ib/Ia) of a boost current value Ib to a base current value Ia in the current supply command signal Is in the low power lighting mode. Furthermore, the lighting power control unit 55 has a function of outputting, to the driver circuit 45, a drive signal Ds, which drives the switching elements Q1-Q4 forming the full bridged circuit U2 and which has frequency corresponding to the lighting mode of the high pressure discharge lamp 10, based on a result of the judgment of the lighting mode performed by the lighting mode setting unit 56. Alternating current driving frequency can be adjusted by adjusting the switching cycle of the switching elements Q1-Q4.

The current and voltage detecting unit 51 has a function of computing the lamp current, which actually flows through the high pressure discharge lamp 10 and the lamp lighting voltage, and computing lamp lighting power from the calculated value of lamp current and that of lamp lighting voltage, based on both end voltage of the resistor Rx for current detection and both end voltage of the series circuit Vx for detection of voltage to be detected.

As described below, in the low power lighting mode, the power change amount calculation unit 52 has a function of computing power difference between a value of the operation power (lamp lighting power) of the high pressure discharge lamp 10 in which base lighting is carried out by supply of the base current, and a value of operation power (lamp lighting power) of the high pressure discharge lamp 10 in which boost lighting is carried out by supply of the boost current.

The adjusted luminance calculation unit 53 has a function of sending the luminance control signal Ls according to the power difference computed by the power change amount calculation unit 52, to the video signal control device 31, wherein the luminance control signal Ls is used for adjusting the luminance of the video signal outputted from the projector control device 30.

Description of an operation of the electric supply device 40 will be given below. First, when the lighting mode setting signal Ms outputted from the projector control device 30 is inputted into the lighting mode setting unit 56, the lighting mode setting unit 56 performs distinction (judgment) processing to determine which lighting mode should be performed for the high pressure discharge lamp 10, thereby outputting a lighting mode distinction signal to the lighting power control unit 55. Moreover, the current supply command signal Is corresponding to the lighting mode setting signal Ms is inputted into the lighting power control unit 55 from the projector control device 30, so that the switching element Qx in the step down chopper circuit U1 is operated at a controlled duty ratio, and the lighting power control unit 55 outputs the drive signal Ds corresponding to the lighting mode to the driver circuit 45 in the full bridged circuit U2, thereby driving the switching elements Q1-Q4. As a result, the direct current voltage supplied from the direct current power source is decreased to a predetermined magnitude by the step down chopper circuit U1, and the direct current voltage is converted into alternating current voltage by the full bridged circuit U2. After that, rectangle wave alternating current is supplied to the high pressure discharge lamp 10 by the starter circuit U3, thereby lighting the high pressure discharge lamp 10.

And when the high pressure discharge lamp 10 is lighted, a value of the lamp current which actually flows through the high pressure discharge lamp 10 and a value of lamp lighting voltage are calculated by the current and voltage detecting unit 51, the lamp lighting power is computed from these values, and then a result thereof is outputted to the lighting power control unit 55. And an operation of the switching element Qx of the step down chopper circuit U1 is adjusted by the lighting power control unit 55, at a controlled duty ratio which is controlled so that the value of the calculated lamp lighting power may agree with the power value based on the inputted current supply command signal Is. Since the electric power supplied to the high pressure discharge lamp 10 can be changed by turning on and off the switching element Qx according to the duty ratio of the gate signal Gx, the gate signal Gx is controlled so that the duty ratio of the switching element Qx is increased when the lamp lighting power is raised, and the duty ratio of the switching element Qx is decreased when the lamp lighting power is decreased. Moreover, when the boost lighting is performed in the low power lighting mode, the boost current is supplied by controlling the gate signal Gx so that the duty ratio of the switching element Qx may be greater than the duty ratio in the base lighting, in which the base current is supplied.

Specifically, in the case where the lighting mode setting unit 56 determines that the inputted current supply command signal Is relates to the steady lighting mode in which electric power whose magnitude is 70% or more of that of rated power is supplied to the high pressure discharge lamp 10, while the switching element Qx is operated by the lighting power control unit 55 at a predetermined duty ratio, which corresponds to the steady lighting mode, the drive signal Ds is outputted to the driver circuit 45 of the full bridge circuit U2 thereby driving the driver circuit 45 so that a polarity reversal operation according to the drive signal (gate signals G1-G4) outputted from the driver circuit 45 is performed in the full bridge circuit U2, whereby current, which has a predetermined frequency selected from, for example, a range of 100 Hz-5 kHz and which has a set and fixed magnitude, is supplied to the high pressure discharge lamp 10, so that the high pressure discharge lamp 10 may be lighted.

Figure 4:
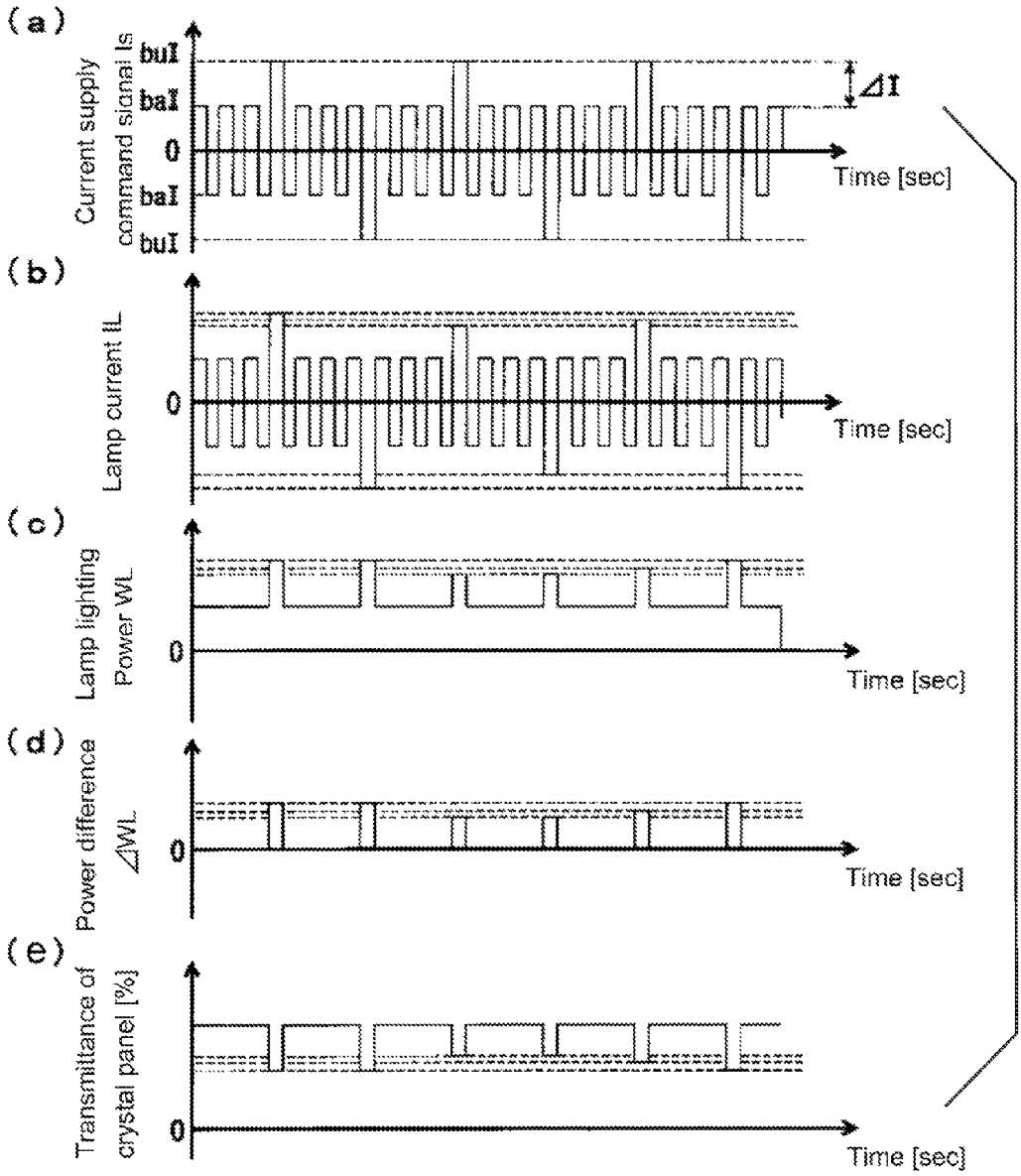
FIG. 4 is a diagram showing an example of a lighting waveform of a high pressure discharge lamp in a low power lighting mode, and a waveform showing the transmittance of a liquid crystal panel, wherein specifically (a) shows a waveform of a current supply command signal, (b) shows a waveform of lamp current which actually flows through a high pressure discharge lamp, (c) shows a waveform of lamp lighting power, (d) shows a waveform illustrating a change amount of the lamp lighting power due to current change accompanying boost lighting, and (e) shows a waveform of the transmittance of a liquid crystal panel.

In the case where the lighting mode setting unit 56 determines that the inputted current supply command signal Is relates to the low power lighting mode in which electric power whose magnitude is less than 70% of the rated power (practically 40-70%) is supplied to the high pressure discharge lamp 10, while the switching element Qx is operated by the lighting power control unit 55 at the predetermined duty ratio, which corresponds to the low power lighting mode and which is less than that in the steady lighting mode, the drive signal Ds is outputted to the driver circuit 45 of the full bridge circuit U2 to drive the driver circuit 45 so that base current, which has predetermined frequency selected from, for example, a range of, for example, 100 Hz-5 kHz and which has a set and fixed magnitude, is continuously supplied to the high pressure discharge lamp 10, and boost current, which is obtained by superimposing current having a predetermined magnitude on the base current, is supplied periodically to the high pressure discharge lamp 10 so as to be lighted. An example of waveform of the current supply command signal in the low power lighting mode is shown in FIG. 4 (*a*).

A concrete example of the lighting conditions of the high pressure discharge lamp 10 will be given below. When the rated power of the high pressure discharge lamp 10 is 230 W (lamp input current 3 A) and lighting frequency is 170 Hz, the lamp lighting power at time of the base lighting in the low power lighting mode is 115 W (which is 50% of the rated power, and the base current is 2.3 A) and the lamp lighting power at time of boost lighting is 118 W (which is 51% of the rated power and the boost current is 3 A (boost rate thereof is 130%)).

As described above, since the temperature of the vapor in the electrical discharge space and the temperature of the electrodes are low when the high pressure discharge lamp 10 is lighted by the low power lighting mode, mercury in the electrical discharge space is unsaturated, that is, part of the mercury aggregates, so that it is necessary to take time to evaporate the mercury. Therefore, a change of lamp lighting power cannot be actually predicted in response to a steep change of the current supply command signal, when the high pressure discharge lamp is lighted in the boost lighting. For this reason, as shown in FIG. 4 (*a*), even where the current supply command signal is sent so that the boost current buI, which is obtained by superimposing predetermined current ΔI of a constant magnitude on the base current baI, is supplied to the high pressure discharge lamp 10 in the boost lighting period of a fixed cycle, which is set in advance, as shown in FIG. 4 (*b*), the lamp current IL that actually flows through the high pressure discharge lamp during each boost lighting period varies. For example, in the case where the current supply command signal is sent so that the boost current buI whose magnitude is approximately 140% of that of the base current baI (the magnitude ΔI of the current which is superimposed thereon is approximately 40% of the base current baI) may be supplied, the lamp current IL that actually flows through the high pressure discharge lamp may be, for example, approximately 130% of the base current baI in one boost lighting period, or may be, for example, approximately 120% of the base current baI in another boost lighting period. Therefore, as shown in FIG. 4 (*c*), the lamp lighting power WL varies in each boost lighting period so that the luminance of the light emitted from the high pressure discharge lamp varies in each boost lighting period and is not be constant. FIG. 4 (*d*) shows a waveform of an amount change of the lamp lighting power due to current change accompanying the boost lighting, specifically, a power difference ΔWL between a value of lamp lighting power of the high pressure discharge lamp lighted by supply of the base current and a value of lamp lighting power of the high pressure discharge lamp lighted by supply of the boost current.

In the electric supply device 40 according to this embodiment, the electric supply device control unit U4 has a function of outputting, to the video signal control apparatus 31, the luminance control signal Ls for adjusting the luminance of the video signal Vs, which is outputted from the projector control device 30 and which corresponds to the value of the lamp lighting power of the high pressure discharge lamp 10 in which the boost lighting is carried out by supply of the boost current. The transmittance of the liquid crystal panel 25 of the projector apparatus is adjusted in a manner described below.

Figure 5:
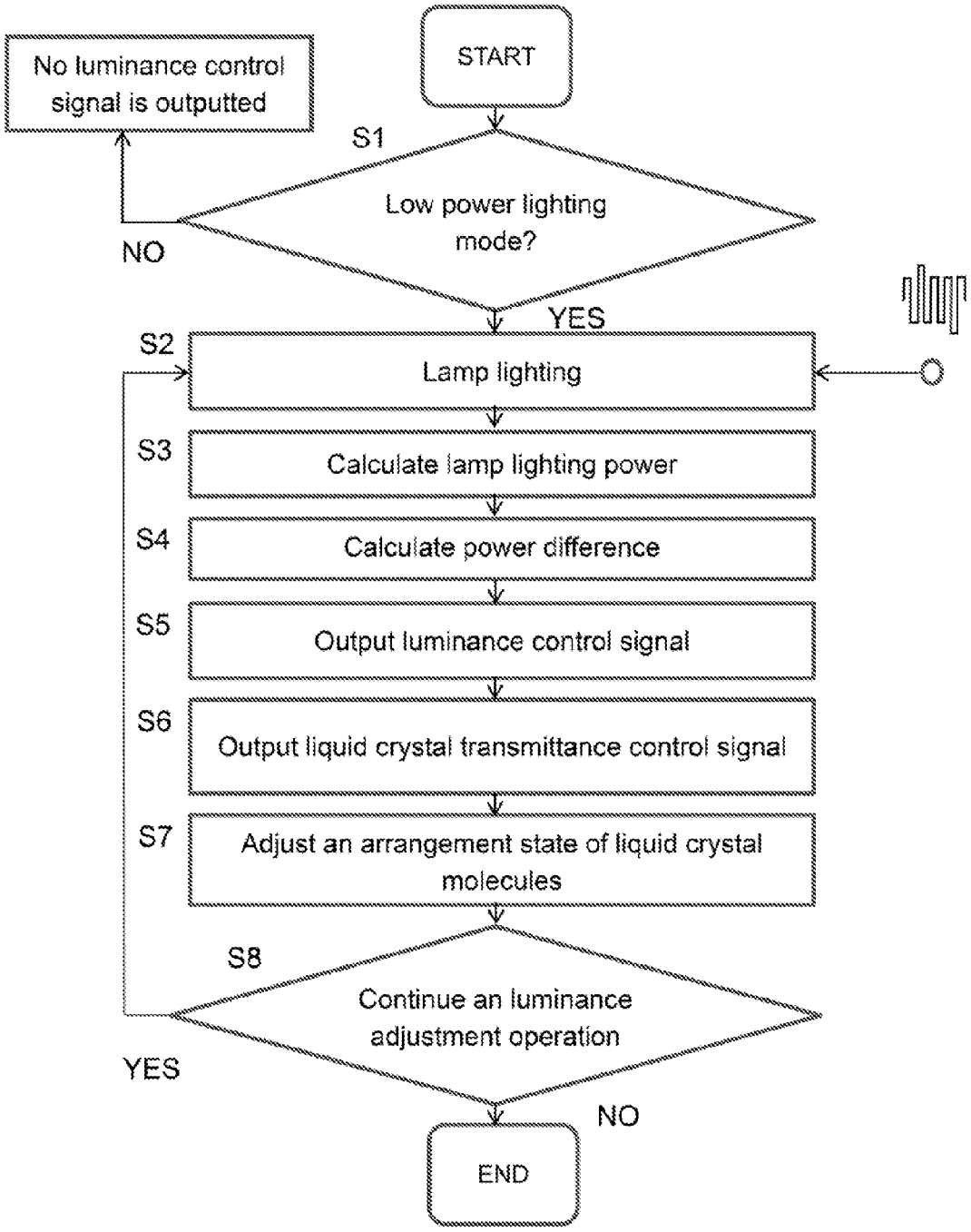
FIG. 5 is an operation flow diagram for explaining a luminance control operation accompanying boost lighting in a low power lighting mode according to an embodiment of the present invention.

As shown in FIG. 5, first, judgment processing is carried out to determine whether the lighting mode setting signal Ms inputted into the lighting mode setting unit 56 from the projector control device 30 relates to a low power lighting mode (S1). When it is determined that the lighting mode setting signal Ms relates to the low power lighting mode, for example, as shown in FIG. 4 (*a*), while the base current baI having a predetermined frequency and a set and fixed magnitude is supplied continuously, the current supply command signal Is is inputted into the lighting power control unit 55 so that the boost current, which is obtained by superimposing current ΔI having a set and fixed magnitude on the base current baI, may be supplied to the high pressure discharge lamp 10, and the high pressure discharge lamp 10 is lighted with the electric power which corresponds to the low power lighting mode by controlling the duty ratio of the switching element Qx of the step down chopper circuit U1 by the lighting power control unit 55 based on the current supply command signal Is. In this low power lighting mode, a "half-cycle boosting" is performed thereby lighting the high pressure discharge lamp 10 (S2). In the half-cycle boosting, only a half-cycle of the boost lighting, in which electric power is increased by supplying the boost current buI obtained by superimposing current ΔI of the fixed magnitude on the base current baI, is performed.

At the time of lamp lighting, while the lamp current IL is calculated by the current and voltage detecting unit 51, the lamp lighting voltage is calculated, and the lamp lighting power (operation power) is calculated from the value of the lamp current IL and the value of lamp lighting voltage (S3). And a power difference (the amount of power change due to current change) between the calculated value of the lamp lighting power at the time of the boost lighting and the calculated value of the lamp lighting power at the time of the base lighting, is calculated by the power change amount calculation unit 52 (S4).

Next, the luminance control signal Ls for adjusting the luminance of the video signal outputted from the projector control device 30 is outputted by the adjusted luminance calculation unit 53, wherein the luminance control signal Ls is set according to the power difference calculated by the power change amount calculation unit 52 (S5). The liquid crystal transmittance control signal Ts, which is obtained by adjusting the luminance of the video signal Vs outputted from the projector control device 30 based on the luminance control signal Ls outputted from the adjusted luminance calculation unit 53 of the electric supply device 40, is outputted by the video signal control apparatus 31 (S6). And the liquid crystal panel drive signal Ps corresponding to the liquid crystal transmittance control signal Ts outputted from the video signal control apparatus 31 is outputted by the liquid crystal panel drive device 32, so that the liquid crystal panel 25 is driven based on the adjusted transmittance (S7). The luminance control signal Ls is set up according to the power difference between the value of the lamp lighting power when boost lighting is carried out and the value of the lamp lighting power when the base lighting is carried out. Specifically, as shown in FIG. 4 (*e*), it is set up so that the transmittance of the liquid crystal panel 25 may become low as the power difference ΔWL between the value of the lamp lighting power at time of the base lighting and the value of the lamp lighting electric power at time of the boost lighting becomes large.

After that, judgment processing for determining whether to continuously perform such a luminance control operation is performed by the lighting mode setting unit 56. When there is no input of the lighting mode setting signal Ms which relates to a change of the lighting mode to a steady lighting mode, the luminance control operation is continuously carried out. When there is an input of the lighting mode setting signal Ms which relates to a change of the lighting mode to a steady lighting mode, the luminance control operation is ended.

In addition, in the steady lighting mode such as a rated power lighting mode, in which the rated power is supplied, current, which has a set and fixed magnitude and which has predetermined frequency selected from, for example, a range of 100 Hz-5 kHz, is supplied to the high pressure discharge lamp 10, and the liquid crystal transmittance control signal Ts corresponding to the luminance of the video signal Vs outputted from the projector control device 30 is outputted without performing the luminance control operation by the electric supply device 40, so that the liquid crystal panel 25 may be driven.

According to the electric supply device 40 having the above-mentioned structure, since the luminance control signal Ls corresponding to a power difference ΔWL is outputted from the electric supply device control unit U4 in every boost lighting period in the low power lighting mode, the transmittance of the liquid crystal panel 25 is controlled by an adjustment amount adapted to the actual lighting state at the time of boost lighting. Accordingly, it is possible to certainly prevent or control generation of areas of different brightness in a projection image projected on a projection screen 28 (for example, generation of the luminance unevenness due to horizontal stripe noise etc.), while controlling generation of a flicker.

Moreover, when a dark video (image) is projected, lamp input power is usually reduced. However, if the boost lighting is performed in the low power lighting mode with the same boost rate as that in the case where a bright image is projected, the electrode temperature drops so that a flicker occurs. In such a case, an increase of boost rate may be considered. However, in a projector that does not have the above-mentioned electric supply device 40, compared with the case of the base lighting, the brightness of the projection image at the time of boost lighting becomes high, so that unevenness of luminance and a flicker may be perceived. Therefore, in the electric supply device 40 having the above-mentioned structure, since the transmittance of the liquid crystal panel 25 is controlled by an adjustment amount adapted to the actual lighting state at the time of the boost lighting, it is possible to certainly perform appropriate luminance adjustment even when a dark video (image) is projected.

In the above-described embodiments, while the base current is continuously supplied to the high pressure discharge lamp 10 in the low power lighting mode, the boost current is supplied to the high pressure discharge lamp 10 at a fixed cycle so as to turn on the lamp 10. However, preferably the boost current can be applied in response to a measured value of the lighting voltage of the high pressure discharge lamp 10, by controlling the supply timing of the boost current, the magnitude of the boost current and/or the supply period of boost current, in the low power lighting mode, according to the measured value of the lighting voltage of the high pressure discharge lamp.

Figure 6:
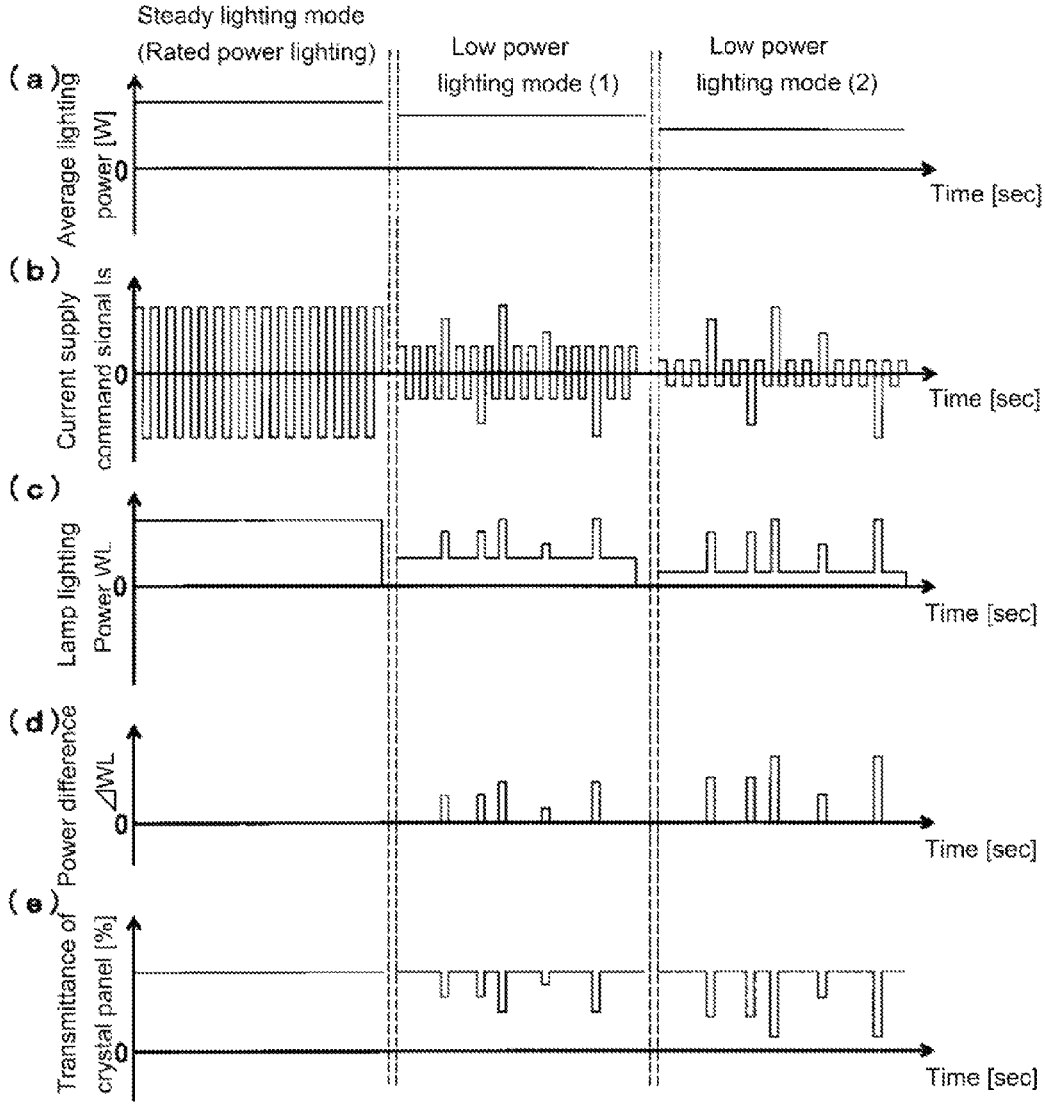
FIG. 6 is a diagram showing another example of a lighting waveform of a high pressure discharge lamp in a low power lighting mode, and that of the transmittance of a liquid crystal panel, wherein specifically (a) shows a waveform of an average lighting power of the high pressure discharge lamp, (b) shows a waveform of a current supply command signal, (c) shows a waveform of lamp lighting electric power, (d) shows a waveform illustrating a change amount of a lamp lighting power due to current change accompanying boost lighting, and (e) shows a waveform of the transmittance of a liquid crystal panel.
Figure 7:
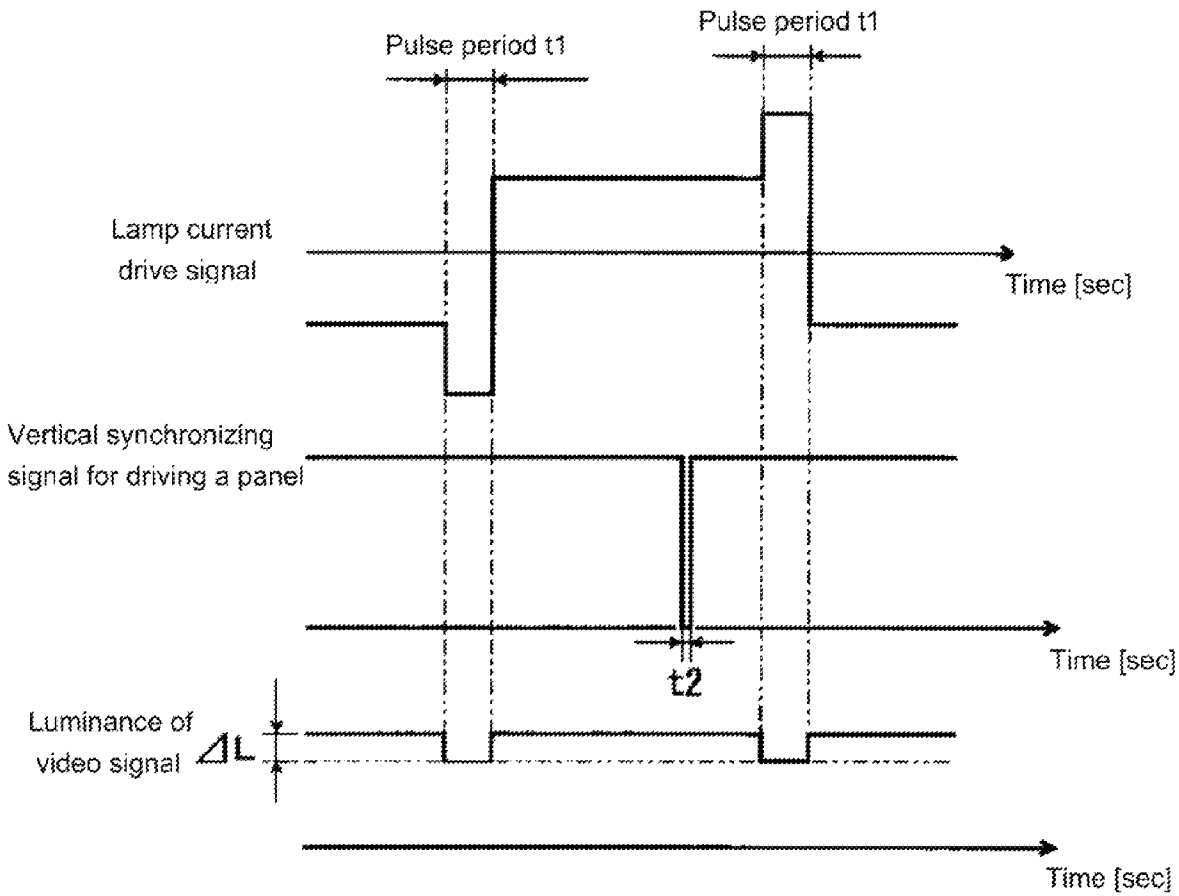
FIG. 7 PRIOR ART
FIG. 7 is a diagram showing an example of a lighting waveform at time of boost lighting in a projection apparatus of prior art together with a luminance control signal of a video signal.

FIG. 6 is a diagram showing another example of a lighting waveform of a high pressure discharge lamp in a low power lighting mode, and that of transmittance of a liquid crystal panel, wherein (a) shows a waveform of an average lighting power of a high pressure discharge lamp, (b) shows a waveform of a current supply command signal, (c) shows a waveform of lamp lighting power, (d) shows a waveform illustrating a change amount of a lamp lighting power due to current change accompanying boost lighting, and (e) shows a waveform of the transmittance of a liquid crystal panel. In this example, in the low power lighting mode (1), the lamp is lighted during base lighting with lamp lighting power having the magnitude of 50 to 70% of the rated power, for example, 60%, (FIG. 6 (*a*)). For example, while base current which has a set and fixed magnitude and which has a predetermined frequency selected from, for example, a range of 100 Hz-5 kHz is supplied, the boost current is supplied under boosting conditions that are set according to the measured value of the lamp lighting voltage of the high pressure discharge lamp 10, which is detected by the current and voltage detecting unit 51. Specifically, the boost conditions are, for example, the magnitude of the current to be superimposed on the base current, timing at which the boost current is supplied, and a time interval (cycle) at which the boost current is supplied (FIG. 6 (*b*)). The boost current is supplied when it is detected that the measured value of the lighting voltage of the high pressure discharge lamp 10 is lower than a predetermined standard value (timing at which the boost current is supplied), wherein the magnitude (boost rate) of the boost current is set so as to become large as a difference between the measured value of the lamp lighting voltage of the high pressure discharge lamp 10 and a predetermined standard value, becomes large.

And the luminance control signal Ls, which corresponds to a power difference ΔWL (FIG. 6 (*d*)), is outputted in every boost lighting period, wherein the power difference ΔWL is a difference between a value of the lamp lighting power calculated from the measured value of the lamp current IL and the measured value of lamp lighting voltage at during base lighting (FIG. 6 (*c*) and a value of the lamp lighting power calculated from the measured value of lamp current IL and the measured value of lamp lighting voltage during boost lighting (FIG. 6 (*c*)). The liquid crystal panel 25 is driven with the transmittance which is adjusted based on a liquid crystal transmittance control signal Ts. The liquid crystal transmittance control signal Ts is obtained by adjusting the luminance of the video signal Vs outputted from the projector control device 30 (FIG. 6 (*e*)).

The low power lighting mode (2) is performed in the same way as that of the low power lighting mode (1) except that the lamp is lighted during base lighting by applying lamp input power having a magnitude of 25 to 50% of the rated power, for example, 40%, (FIG. 6 (*a*)), and in the low power lighting mode (2), boost lighting, in which the boost rate is larger than that of the low power lighting mode (1), is performed (FIG. 6(*b*)). That is, the luminance control signal Ls, which corresponds to the power difference ΔWL (FIG. 6 (*d*)), is outputted in every boost lighting period, and the liquid crystal panel 25 is driven with the transmittance, which is adjusted based on a liquid crystal transmittance control signal Ts, wherein the liquid crystal transmittance control signal Ts is obtained by adjusting the luminance of the video signal Vs from the projector control device 30 (FIG. 6 (*e*)).

In the electric supply device 40 having a function of controlling the supply timing of superposed electric power, an electric power value of the superposed electric power, or a supply period of the superposed electric power, according to a measured value of the lighting voltage of the high pressure discharge lamp 10, in the low power lighting mode (1) and the low power lighting mode (2), since the quantity of the electrode substance, which exists around the electrodes 14 and 15 of the high pressure discharge lamp 10 and which is evaporated, increases so that deposition of the evaporated electrode substance on the electrodes 14 and 15 of the high pressure discharge lamp 10 is facilitated, consumption of the electrodes 14 and 15 of the high pressure discharge lamp 10 and generating of a flicker can be prevented or controlled much more certainly. And since the transmittance of the liquid crystal panel 25 is controlled by an adjustment amount adapted to the actual lighting state at time of boost lighting, even when the current that is inputted every boost lighting period varies, or the timing of a boost lighting period is not periodic, expected luminance control can be performed certainly.

Although the embodiments of the present invention are explained above, the present invention is not limited to the above-mentioned embodiments, and various modification can be made. For example, in the description of the above-mentioned embodiments, although the a "half-cycle boost" is performed in the low power lighting mode, a "full cycle boosting," in which boost lighting is performed for 1 cycle or a couple cycles, may be performed. Moreover, the frequency of base current and the frequency of boost current do not need to be the same as each other, that is, they may differ from each other.

The preceding description has been presented only to illustrate and describe exemplary embodiments of the present electric supply device. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. An electric supply device for a high pressure discharge lamp for supplying alternating current to the high pressure discharge lamp used as a light source of a liquid crystal projector apparatus, comprising:

an electric supply device control unit configured to switch between a steady lighting mode, in which first electric power that is not less than 70% of a rated power is supplied to the high pressure discharge lamp, and a low power lighting mode, in which second electric power lower than the first electric power is supplied to the high pressure discharge lamp, by performing constant electric power control, thereby lighting the high pressure discharge lamp, wherein the electric supply device control unit is configured to, while in the low power lighting mode, (i) continuously supply a predetermined base current to the high pressure discharge lamp, (ii) send a current supply command signal so that boost current, which is obtained by superimposing current having a predetermined magnitude on the base current, is periodically supplied to the high pressure discharge lamp, and (iii) send a luminance control signal to adjust the luminance of a video signal of the liquid crystal projector apparatus according to a magnitude of operation power of the high pressure discharge lamp, which is operated responding to the supply of the boost current.

2. The electric supply device for a high-pressure discharge lamp according to claim 1, wherein the luminance control signal is set according to a power difference between (i) the operation power of the high pressure discharge lamp when the base current is supplied, and (ii) the operation power of the high pressure discharge lamp when the boost current is supplied.

3. The electric supply device for a high-pressure discharge lamp according to claim 1, wherein, in the low power lighting mode, the current supply command signal controls, according to a measured value of a lighting voltage of the high pressure discharge lamp: a supplying timing of the boost current, a magnitude of the boost current, or a supplying period of the boost current.

4. The electric supply device for a high-pressure discharge lamp according to claim 2, wherein, in the low power lighting mode, the current supply command signal controls, according to a measured value of a lighting voltage of the high pressure discharge lamp: a supplying timing of the boost current, a magnitude of the boost current, or a supplying period of the boost current.

* * * * *